US009198472B2

(12) United States Patent
Hilburn

(10) Patent No.: US 9,198,472 B2
(45) Date of Patent: Dec. 1, 2015

(54) GLOVE FOR GROUTING TILE

(71) Applicant: Patrick William Hilburn, Chicago, IL (US)

(72) Inventor: Patrick William Hilburn, Chicago, IL (US)

( * ) Notice: Subject to any disclaimer, the term of this patent is extended or adjusted under 35 U.S.C. 154(b) by 0 days.

(21) Appl. No.: 13/680,994

(22) Filed: Nov. 19, 2012

(65) Prior Publication Data

US 2013/0125503 A1 May 23, 2013

Related U.S. Application Data

(60) Provisional application No. 61/561,825, filed on Nov. 18, 2011.

(51) Int. Cl.

| | |
|---|---|
| ***A41D 19/00*** | (2006.01) |
| ***E04F 21/24*** | (2006.01) |
| ***E04G 23/02*** | (2006.01) |

(52) U.S. Cl.

CPC ..... *A41D 19/0024* (2013.01); *E04F 21/241* (2013.01); *E04G 23/0203* (2013.01); *A41D 2600/20* (2013.01)

(58) Field of Classification Search

CPC ..... A41D 19/0024; A41D 2600/20; E04F 21/241; E04G 23/0203

USPC ..... 2/160, 163, 161.1, 161.6; 52/742.16

See application file for complete search history.

(56) References Cited

U.S. PATENT DOCUMENTS

| | | | | | |
|---|---|---|---|---|---|
| 1,530,327 | A * | 3/1925 | Redlick | 401/7 |
| 4,757,556 | A | 7/1988 | Girard | |
| 4,807,322 | A | 2/1989 | Littledeer | |
| 4,827,557 | A * | 5/1989 | Siler et al. | 15/245 |
| D347,716 | S * | 6/1994 | Pomerleau | D32/46 |
| 5,369,257 | A * | 11/1994 | Gibbon | 219/759 |
| 6,351,867 | B1 | 3/2002 | Forster | |
| 2002/0010957 | A1 * | 1/2002 | Katz | 2/161.7 |
| 2004/0074036 | A1 * | 4/2004 | Collier | 15/245 |
| 2005/0177965 | A1 * | 8/2005 | Edoh | 15/160 |
| 2008/0235850 | A1 * | 10/2008 | Cabauy et al. | 2/161.8 |
| 2008/0289080 | A1 * | 11/2008 | Szucs | 2/161.1 |
| 2009/0183295 | A1 * | 7/2009 | Rhee | 2/161.2 |
| 2010/0242154 | A1 * | 9/2010 | Hale | 2/161.8 |
| 2011/0041225 | A1 * | 2/2011 | Harvey et al. | 2/21 |
| 2013/0227760 | A1 * | 9/2013 | Mahon | 2/160 |

* cited by examiner

*Primary Examiner* — Katherine Moran

(74) *Attorney, Agent, or Firm* — Hinshaw & Culbertson LLP

(57) ABSTRACT

The present invention provides ergonomic grouting tools attached to a glove, mitt, brace, or other passive retention means worn on the hand of a user and methods of using them. In particular, one grouting tool according to the invention includes an elongate tool blade, which may for example be a squeegee, a hollow flexible tube, or a solid, flexible, generally round member, attached proximate to and extending along the fifth digit side of a glove. Reinforcement material integral with the tool blade is preferably included to prevent the tool blade from pulling away from a user's hand during use. The glove itself may be composed of fabric dip-coated in plastic, or otherwise waterproofed/sealed, over palm and finger portions, and uncoated over a wrist region and part of a region covering the back side of a user's hand to provide breathability and comfort.

10 Claims, 1 Drawing Sheet

GLOVE FOR GROUTING TILE

CROSS REFERENCE TO RELATED APPLICATION

This application claims the benefit of U.S. Provisional Application No. 61/561,825, filed Nov. 18, 2011, the entirety of which is incorporated herein by reference

FIELD OF THE INVENTION

The present invention relates to tools and methods for grouting tile. More particularly, it relates to grouting tools incorporated in gloves or mitts and methods of using them.

BACKGROUND OF THE INVENTION

Tile grouting is a labor intensive task typically requiring many consecutive strokes with a manual tool for a given job. As a result, grouting using existing tools, such as floats with handles which must be gripped in the user's hand, commonly results in fatigue or even pain or injury in the hand, wrist and/or forearm associated with repetitive motion.

A need therefore exists for an ergonomic grouting tool that facilitates consistent grouting while reducing fatigue and the risk of pain or injury to the user related to repetitive motion stresses.

BRIEF SUMMARY OF THE INVENTION

In accordance with one aspect of the present invention, a grouting tool to be worn on the hand of a user is provided. The tool includes a passive hand retaining portion adapted to receive the inserted open hand of a user. In the preferred embodiment illustrated herein, the passive hand retaining portion is a glove, but any suitable passive hand retaining means may alternatively be used, including but not limited to a mitt; one or more adjustable straps, ties, or elastic bands; one or more bracelets or rings; or any suitable combination thereof. Attached to the passive hand retaining portion is an elongate tool blade that extends alongside and generally parallel to at least a portion of the fifth digit side of a user's open hand inserted into the passive hand retaining portion.

If the passive hand retaining portion is a glove, the glove preferably comprises a joined finger configured to receive the fourth and fifth digits of user's hand and to restrain the fourth and fifth digits from flexing or extending separately from each other. This beneficially enables the user to leverage more strength and stiffness when pushing the tool blade across a tiled surface to be grouted. Also, at least substantially the entire palm side and finger portions of the glove are preferably water impermeable to keep the user's hands relatively clean, and at least a portion of the back side of the glove is breathable for comfort.

The elongate tool blade may have any suitable shape for pushing and collecting grout as the tool blade is moved transversely across a grout-bearing surface. In this regard, the present inventor has found that a generally round shape is preferable to a squeegee shape, because the round shape provides better stiffness. Generally flat tool reinforcement material is preferably provided integral with the elongate tool blade, the tool reinforcement material attached to the passive hand retaining portion and configured to extend over at least a portion of the palm side of a user's hand when the user's hand is inserted into the passive hand retaining portion. The tool reinforcement material should help prevent the tool blade from being pulled away from the side of a user's hand during use. Preferably, the reinforcement material extends over substantially the entire palm side of a user's fourth and fifth digits when the user's hand is inserted into the passive hand retaining portion, and substantially across the user's palm, from the fifth digit side at least to the second digit side.

According to another aspect of the present invention, a method of grouting using the grouting tool of the invention is provided. According to the method, a user's open hand is inserted into the passive hand retaining portion of the grouting tool, the tool blade is placed in contact with a tiled surface bearing grout material, and the user passes the elongate tool blade along the tiled surface in a direction transverse to the length of the elongate tool blade. Preferably, the user's hand is slightly cupped, rather than extended fully straight, for the user's comfort and to aid in gathering the grout by guiding the grout material towards the center of the stroke path of the tool blade.

DETAILED DESCRIPTION OF THE INVENTION

Grouting tools attached to a glove, mitt, brace, or other passive retention structure worn on the hand of a user and methods of using them are described in this section. The present inventor has found that a grouting glove according to the invention is far more ergonomic than existing grouting tools for at least two reasons. For one, the grouting glove of the invention is passively worn on a user's hand, thus eliminating the need for the user to grip the grouting tool and hold it at an effective angle while at the same time manipulating it, thus reducing the exertion required. In addition, the present grouting glove allows the user to apply strokes of the grouting tool with his or her hand in an open, cupped position, a more natural and relaxed position for the hand than one in which the hand is gripping a grouting tool, as is done according to existing grouting methods using existing tools.

Figure 1:
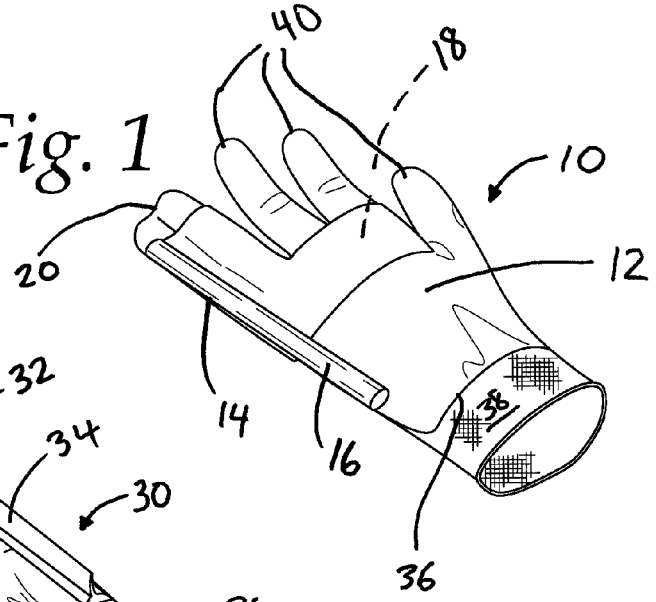
FIG. 1 is a perspective view of one embodiment of a grouting glove according to the invention.

With reference to FIG. 1, a grouting glove 10 according to one embodiment of the invention is illustrated. Grouting glove 10 includes a glove portion 12 and a tool portion 14 attached to glove portion 12. Tool portion 14 includes an elongate, flexible, generally round tool blade 16 and, preferably, reinforcement material 18 extending over and attached to a portion of a palm side of glove portion 12, including substantially the entire palm side of a joined finger 20 of glove portion 12, which is configured to receive a user's fourth and fifth digits inserted together. One skilled in the art will understand that configurations of reinforcement material other than that shown for reinforcement material 18 are also possible. In the configuration shown, reinforcement material 18, which is advantageously flexible but not easily stretched, inhibits tool blade 16 from pulling away from the user's hand to the extent that might otherwise be permitted by shifting or stretching of the fabric interior of glove portion 12 as a user pushes tool blade 16 across a tiled surface in the direction indicated in FIG. 3. Also, reinforcement material 18 may help prevent tool blade 16 from detaching from glove portion 12, by providing an area over which tool portion 14 is attached to glove portion 12 that is broader than merely the part of tool blade 16 that is directly adjacent glove portion 12, thus minimizing the stresses of use by spreading them out over a larger area.

Figure 2:
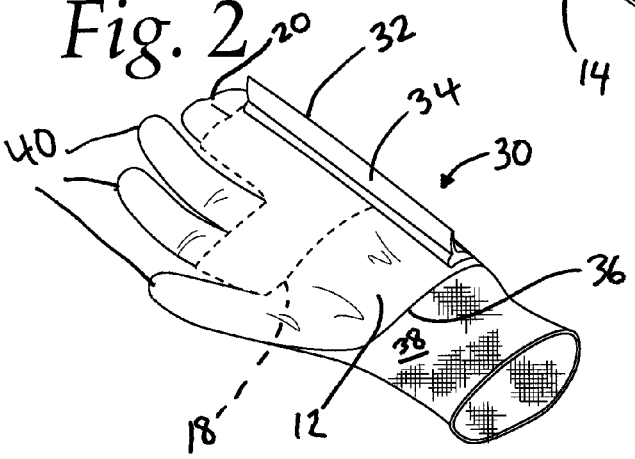
FIG. 2 is a perspective view of another embodiment of a grouting glove according to the invention.

The structure of an alternative grouting glove 30 is illustrated in FIG. 2. Grouting glove 30 includes mostly similar elements to those of grouting glove 10, designated by the same reference numerals as in FIG. 1, but differs from grouting glove 10 in that it comprises a tool portion 32 having a squeegee tool blade 34 instead of generally round tool blade 16.

Preferably, grouting gloves 10 and 30 are made to be substantially waterproof. For example, they may be composed of a porous fabric inner lining 38, which is preferably breathable and stretchable, dip-coated in a water-impermeable polymer coating 36, as depicted in FIGS. 1 and 2, respectively. However, to retain some breathability for user comfort, dip-coating is preferably not applied to a wrist region (seen in FIGS. 1-3) and part of the back of a hand region (seen in FIG. 3) of gloves 10 and 30, leaving some area of fabric lining 38 exposed. The polymer coating also makes the glove more durable and resistant to the abrasive nature of grout, particularly sanded grout. Also, while generally round tool blade 16 may comprise, for example, a length of flexible hollow rubber tubing, in that case the dip coating step preferably seals the ends of the tubing, leaving tool blade 16 with a closed end as depicted in FIG. 1. The closed ends of tool blade 16 advantageously prevent grout material from passing into the interior of tool blade 16, which could potentially wear away the material of tool blade 16 and/or impact its flexibility and performance. Alternatively, tool blade 16 may be a solid member with no hollow interior, avoiding the need for the ends of tool blade 16 to be sealed by polymer coating 36 to prevent grout from entering tool blade 16.

Grouting glove 10 or 30 may be constructed by attaching tool portion 14 or 32, including the respective tool blade 16 or 34 and reinforcement material 18, to grouting glove 10, and then dipping the assembled glove into polymer coating 36. In addition to covering a portion of the fabric lining of grouting glove 10, polymer coating 36 will then cover tool portion 14 or 32. The location of reinforcement material 18 under polymer coating 36 is designated by a dashed lead line in FIG. 1, in which visible lines depict the edges of a raised portion of polymer coating 36 resulting from the thickness of reinforcement material 18 being added to the thickness of polymer coating 36. In FIG. 2, hidden lines depict the edges of reinforcement material 18 under polymer coating 36, corresponding to the visible lines depicting the raised portion of polymer coating 36 in FIG. 1.

Grouting glove 10 is preferred to grouting glove 30, as the present inventor has found that generally round tool blade 16 performs better than squeegee tool blade 34. In particular, the generally round shape of tool blade 16 tends to provide more stiffness than the squeegee shape of tool blade 34 composed of about the same amount of material, making tool blade 16 more effective for moving grout, which is generally a thick substance, across a tiled surface.

Figure 3:
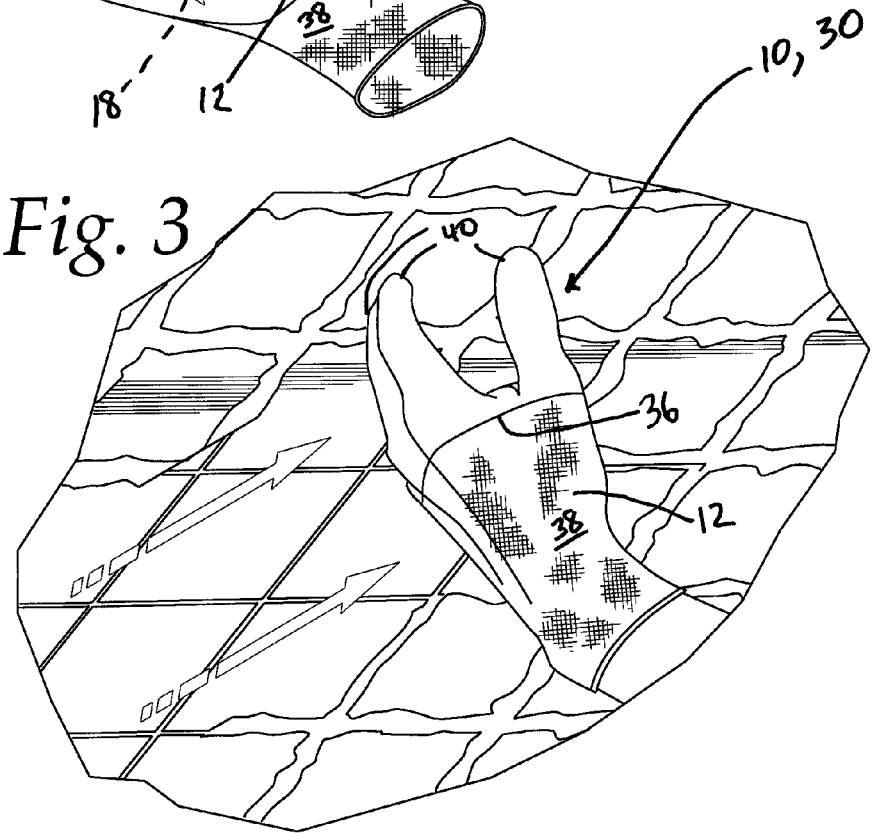
FIG. 3 is a perspective illustration of a method of use of a grouting glove according to the invention.

Joined finger 20 is an important feature of grouting gloves 10 and 30, which serves to restrain each of the user's fourth and fifth digits from flexing or extending independently of the other, thus providing a wearer/user of grouting glove 10 with two-finger leverage behind tool portion 14. An embodiment of the invention including separate fourth and fifth glove fingers is also possible. However, grouting glove 10 including joined finger 20 is preferred, because it allows a user to exert more strength and control of tool blade 16. In particular, when pushing tool blade 16 along a tiled surface to apply/seal grout in joints between tiles and/or to remove grout residue from the surface of the tiles, as depicted in FIG. 3, the user is better able to resist backward bending of tool blade 16 by harnessing the strength and combined stiffness of the user's fourth and fifth digits working together than if his or her pinky were free to bend backwards independently of his or her fourth/ring finger.

In contrast, it will also be noted that grouting gloves 10 and 30 as depicted in FIGS. 1 and 2 include separately flexible fingers 40 for receiving a user's first three digits (thumb, index finger and middle finger). Although it would be possible to retain some of the benefits of the invention in a "mitt" embodiment (not shown) in which all of the second through fifth digits of a user's hand were constrained to flex and extend as a unit, the grouting gloves 10 and 30 are preferred embodiments because a user's index and middle finger remain freely flexible for other uses. This enables a user, for example, to freely pinch or grasp an object between his or her thumb and forefinger while wearing glove 10 or glove 30. In this sense, grouting gloves 10 and 30 take fuller advantage of the passive retention aspect of the invention than would a grouting "mitt" according to the invention. That is, because the tool of the invention is "worn" rather than held or grasped like existing grouting tools, a user can grout while at the same time holding an object, or quickly switch between grouting and picking up an object, without having to worry about constantly picking up and putting down a grouting tool or keeping track of where a grouting tool is placed. The index finger also remains free to push grout into a corner or small void in a joint. These advantages are enhanced by flexible glove fingers 40 permitting the user's thumb and middle and index fingers to freely flex independently of his or her "joined" fourth and pinky fingers.

One skilled in the art will appreciate that, although the invention is illustrated in the Figures and described in the preferred embodiments as a grouting glove 10 or 30, other forms of passive retention of a grouting tool to a user's hand, which may or may not cover the user's entire hand with material, may also be advantageously substituted for glove portion 12. For example, a grouting tool blade may be attached to a harness or one or more elastic bands, adjustable straps, ties, rings and/or bracelets worn around the wrist and/or part of a user's hand.

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A grouting tool to be worn on the hand of a user comprising a glove portion adapted to receive a user's inserted open hand, the glove portion comprising a palm side comprising a palm portion configured to cover the palm of a user's inserted hand, a back side connected to the palm side by an index finger side, a pinky side, and glove fingers, and an opening opposite the glove fingers configured to receive a user's inserted hand, the glove fingers including a glove thumb configured to receive a user's inserted thumb, a glove index finger configured to receive a user's inserted index finger, a glove middle finger configured to receive a user's inserted middle finger, and a glove joined finger having a palm side, a back side, an inner edge adjacent the glove middle finger, and an outer edge at the pinky side of the glove portion, the glove joined finger configured to receive a user's inserted ring and pinky fingers and to substantially restrain the ring and pinky fingers from flexing or extending separately from each other, the glove joined finger configured to extend over at least substantially an entire length of the ring and pinky fingers of the user's inserted hand, and the glove thumb, glove index finger, and glove middle finger configured to flex and extend independently of the glove joined finger; and an elongate tool blade attached to the palm side of the glove portion and protruding from the palm side in a forward direction in which the palm side faces, at least a portion of the length of the elongate tool blade extending along the outer edge of the glove joined finger, further comprising generally flat, flexible, and stretch-resistant tool reinforcement material integral with the elongate tool blade, the tool reinforcement material attached to the glove portion and extending over at least a portion of the palm side of the glove portion.

2. The grouting tool of claim 1, at least the palm side and glove fingers of the glove portion being water impermeable.

3. The grouting tool of claim 2, at least a portion of the back side of the glove portion being breathable.

4. The grouting tool of claim 2, the palm portion and finger portions comprising a breathable material coated by a water-impermeable polymer.

5. The grouting tool of claim 4, said water-impermeable polymer coating covering a tool portion composed of the tool blade and the reinforcement material.

6. The grouting tool of claim 1, the elongate tool blade comprising a squeegee blade.

7. The grouting tool of claim 1, the elongate tool blade having a generally round transverse cross section perpendicular to the length of the elongate tool blade.

8. The grouting tool of claim 1, wherein the glove portion comprises a stretchable fabric interior.

9. The grouting tool of claim 8, the reinforcement material extending over the palm side of the glove joined finger.

10. The grouting tool of claim 8, the reinforcement material extending over the palm portion from a pinky side of the palm portion at least to an index finger side of the palm portion.

* * * * *